US010208663B2

(12) United States Patent
Esders et al.

(10) Patent No.: US 10,208,663 B2
(45) Date of Patent: Feb. 19, 2019

(54) CYLINDER HEAD COVER FOR A MOTOR VEHICLE

(71) Applicant: Polytec Plastics Germany GMBH & Co. KG, Lohne (DE)

(72) Inventors: Helen Esders, Lohne (DE); Hans Janssen, Dinklage (DE)

(73) Assignee: Polytec Plastics Germany GMBH & Co. KG, Lohne (DE)

( * ) Notice: Subject to any disclaimer, the term of this patent is extended or adjusted under 35 U.S.C. 154(b) by 71 days.

(21) Appl. No.: 15/320,121

(22) PCT Filed: Jun. 15, 2015

(86) PCT No.: PCT/EP2015/063326

§ 371 (c)(1),
(2) Date: Dec. 19, 2016

(87) PCT Pub. No.: WO2015/197410

PCT Pub. Date: Dec. 30, 2015

(65) Prior Publication Data

US 2017/0138255 A1 May 18, 2017

(30) Foreign Application Priority Data

Jun. 27, 2014 (DE) ..... 10 2014 212 446

(51) Int. Cl.

| | |
|---|---|
| ***F01L 1/053*** | (2006.01) |
| ***F02B 77/02*** | (2006.01) |
| ***F02F 7/00*** | (2006.01) |
| ***F01L 13/00*** | (2006.01) |

(52) U.S. Cl.

CPC ..... *F02B 77/02* (2013.01); *F01L 1/053* (2013.01); *F01L 13/0015* (2013.01); *F02F 7/006* (2013.01); *F01L 2013/0052* (2013.01); *F01L 2101/00* (2013.01); *F01L 2820/01* (2013.01)

(58) Field of Classification Search

CPC . F02B 77/02; F01L 1/0532; F01L 2001/0535; F01L 2001/0537; F02F 7/006

See application file for complete search history.

(56) References Cited

U.S. PATENT DOCUMENTS

| | | | | |
|---|---|---|---|---|
| 2004/0144349 | A1* | 7/2004 | Wampula | F01L 1/053 123/90.38 |
| 2008/0173273 | A1* | 7/2008 | Cunningham | F02F 7/006 123/195 C |

FOREIGN PATENT DOCUMENTS

| | | | |
|---|---|---|---|
| CN | 101918694 | A | 12/2010 |
| DE | 198 04 607 | C2 | 2/2000 |
| DE | 10 2004 026 658 | A1 | 12/2005 |
| DE | 10 2007 063 254 | A1 | 7/2009 |
| DE | 20 2008 005 019 | U1 | 8/2009 |
| DE | 10 2011 014 335 | A1 | 9/2012 |
| DE | 10 2012 209 860 | A1 | 12/2013 |
| EP | 1 998 034 | A2 | 12/2008 |
| EP | 2 314 849 | A1 | 4/2011 |

OTHER PUBLICATIONS

ATZ—Automobiltechnische Zeitschrift, Mar. 2007, vol. 109, Issue 3, pp. 220-224.

Carl Hanser Verlag, Munchen, KU Kunststoffe, Jhrg. 91(2001) 6; www.kunststoffe.de.

International Search Report for International Application No. PCT/EP2015/063326 dated Aug. 28, 2015.

* cited by examiner

*Primary Examiner* — Jacob Amick

(74) *Attorney, Agent, or Firm* — Seth L. Hudson; Clements Bernard Walker, PLLC

(57) ABSTRACT

The invention relates to a cylinder head cover for a motor vehicle, said cylinder head cover being made of plastic material and being provided with an integrated camshaft timing mechanism.

7 Claims, No Drawings

CYLINDER HEAD COVER FOR A MOTOR VEHICLE

FIELD OF INVENTION

The invention relates to a cylinder head cover for a motor vehicle, made of plastic material and provided with an integrated camshaft timing mechanism.

BACKGROUND

A cylinder head cover, also referred to as a valve cover, is known to be the topmost end of an (upright) four-stroke internal combustion engine.

It harbors the upper actuation elements of the valve train and prevents the lubricating oil from leaking into the environment, and the air from entering the engine.

If the valve train is equipped with an overhead camshaft and the latter is driven by a chain, the cylinder head cover also comprises the camshaft sprockets.

Modern vehicles have a camshaft adjustment, also referred to as a variable camshaft control or variable valve control. This means a method for changing the timing of the valve control of four-stroke engines in operation.

The adjustment of the valve opening times allows the efficiency of the engine to be enhanced, depending on the respective load behavior.

In camshaft adjustment, the inlet and outlet timing is changed by actuators as a function of the revolutions per minute and the throttle position, in order to achieve as efficient as possible a cylinder filling in all speed ranges. Actuators transform electrical signals into mechanical movement in camshaft adjustment, and thus actively intervene with the control system.

The actuator discussed here displaces a cam pack on the camshaft so that a second cam becomes engaged on the valve. Because of the required precision, only aluminum covers are currently being employed for receiving the actuators.

From KU Kunststoffe, vol. 91 (2001) 6, cylinder head covers of polyamide 66 filled with glass fibers and minerals are known that meet all requirements relating to the mechanical load on cylinder head covers even at elevated temperatures, and are supposed to have a high creep strength.

From DE 198 04 607 C2, an assembly for electrically connecting at least one sensor is known, which is contacted through electric connecting lines and is provided on an engine component of an internal combustion engine that is at least partially made of plastic material, characterized in that the electric connecting lines (20) are designed in the form of metallic rails (21) and incorporated in the plastic material of the engine component (3), wherein a first end (24) of the rails (21) forms part of a connector holder (26), and a second end (25) of the rails (21) protruding from the plastic material of the engine component (3) provides corresponding connector contact points (18) for the sensor (1), which is electrically contactable with the rails (21) and thus with the connector holder (26) through a contact plate (14) with contact elements (22) provided between sensor connecting points (8) of the sensor (1) and the connector contact points (18) of the rails (21).

However, the engine components described therein do not comprise a cylinder head cover of a motor vehicle, and in particular, not a cylinder head cover made of plastic material and provided with an integrated camshaft timing mechanism. The metallic rails described therein do not serve to reinforce the engine component surrounding them.

The weight saving potential of plastic cylinder head covers as compared to known aluminum cylinder head covers is about 30 to 50%, a further cost benefit being achievable by consistent integration of functions into the component.

From ATZ—Automobiltechnische Zeitschrift, March 2007, vol. 109, pp. 220 to 224, hybrid covers made of plastic material are known. A cylinder head cover is described in which a rigid, but lightweight metal frame takes over the reinforcing function of the gasket. It is described that the bonding of the two materials can be effected only by an elastomer, in order to both ensure optimum acoustic decoupling and compensate for the different thermal expansions of the components. However, the metal stiffening frame has no contact with the cover body.

DE 198 04 607 C2 describes an assembly for electrically connecting at least one sensor. Said assembly for electrically connecting at least one sensor, which is contacted through electric connecting lines and is provided on an engine component of an internal combustion engine and is at least partially made of plastic material, is characterized in that said electric connecting lines are designed in the form of metallic rails and incorporated in the plastic material of the engine component, wherein a first end of the rails forms part of a connector holder, and a second end of the rails protruding from the plastic material of the engine component provides corresponding connector contact points for the sensor, which is electrically contactable with the rails and thus with the connector holder through a contact plate with contact elements provided between sensor connecting points of the sensor and the connector contact points of the rails. However, this is not a cylinder head cover.

DE 10 2004 026 658 A1 relates to a hybrid housing, especially an engine or gearbox housing. The application has the purpose to provide a housing, especially an engine or gearbox housing, that meets the required stability and precision demands, but has a reduced weight. For this purpose, the application provides a hybrid housing, especially an engine or gearbox housing, with a housing component of metal, on which at least a bearing seat is formed, wherein the housing component is coated with plastic on an interior side and/or exterior side, and the bearing seat is formed in a plastic-free region of the housing component. This publication does not include a cylinder head cover, either, especially not a metal bearing, and no fixture for an actuator. In addition, the housing is not oil-tight.

Hybrid technology is known to combine the properties of two materials, which combination achieves a higher performance than that of the individual materials.

SUMMARY OF THE INVENTION

The object of the present invention is to provide a cylinder head cover for a motor vehicle that has further advantages in addition to the weight advantage, such as the possible omission of additional gaskets, screws and bushings in the case of an additional mounting step.

According to the invention, the above object is achieved by a cylinder head cover for a motor vehicle, made of plastic material reinforced by glass fibers and/or minerals and provided with an integrated camshaft timing mechanism, comprising at least one metallic insert component essentially enclosed by the plastic material, which is in full-area contact with it.

In the broadest sense, the present invention is a cylinder head cover for a motor vehicle, made of plastic material reinforced by glass fibers and/or minerals and provided with an integrated seat for a camshaft timing mechanism, comprising at least one insert component essentially enclosed by the plastic material, which is in full-area contact with it.

DESCRIPTION OF THE EMBODIMENTS

The production of highly stressable and cost-effective components is enabled by the form lock between the plastic and the insert component of the hybrid component as produced, in particular, during the injection molding process. Thus, complex structures can be realized as compared to conventional injection molding.

Over a pure plastic concept, the cylinder head covers according to the invention have technical advantages, especially with respect to the thermal expansion of the metal sheet as compared to the thermal expansion of the camshaft.

According to the invention, it is possible to effect the centering of the cover mounting through the metallic insert component. The direct form lock between the insert component and the plastic material reinforced by glass fibers and/or minerals can achieve a high rigidity of the actuator reception. The influences of temperature, time, humidity, vibration and shrinkage are reduced.

It is particularly preferred according to the present invention that the insert component as a metal sheet part, especially a punched and optionally shaped one, is insert-molded with the plastic material reinforced by glass fibers and/or minerals. A particularly good separation of functions can be realized thereby.

The term "metal sheet part" within the meaning of the present invention includes so-called organic sheets in addition to metallic insert components. "Organic sheets" are parts prepared by forming fiber-reinforced semifinished products with a thermoplastic matrix, combined by thermoplastic injection molding and the thermoforming of continuous fiber-reinforced thermoplasts.

These organic sheets are preferably produced in a preliminary forming process and inserted into the mold as dimensionally stable components, held and insert-molded.

In principle, it is possible to integrate further functional elements by this process combination with injection molding. Thus, the process enables the production of components suitable for large-scale production with short cycle times.

Organic sheets consist of specific fabrics embedded in a thermoplast matrix in defined orientations. The fabrics are produced from glass fiber, kevlar or carbon fibers. For example, polyamide is suitable as a thermoplast matrix, because it exhibits a good adhesion to the fibers, inter alia. The result is hybrid components that are completely made of plastic. As compared to their counterparts made of metallic sheet, they are more lightweight and show a higher surface rigidity and clearly higher strengths. In addition, attachment parts, such as reinforcements or clips, can be integrated by injection onto them. In addition, corrosion protection, which is often an additional cost factor in metallic sheets, can be dispensed with. The investment in a die for deep-drawing is significantly lower with organic sheets as compared to metal. Therefore, the production of hybrid components with organic sheets is worthwhile, above all at low to medium quantities.

The material of a metallic insert component may comprise a steel or aluminum sheet. The desired function of the insert component determines the selection of the corresponding material.

The layer thickness of the insert component can be adjusted as desired, wherein the layer thickness of the insert component in the form of a metal sheet may preferably be 0.75 to 2 mm, especially 1 to 1.5 mm, and may optionally be varied and adapted accordingly to the static or functional requirements. Thus, the metal sheet part may optionally have different thicknesses in different regions, for example, to be able to bear a higher load in certain regions.

In another particular embodiment of the present invention, the metallic insert component is completely enclosed by plastic on one side thereof, whereby an oil-tight cover is formed. The oil-tight cover may also be produced by overlap welding a housing, which covers open regions.

In another preferred embodiment of the present invention, the insert component is partially or completely a support of the actuators of the camshaft, or the plastic seat of the actuators is stiffened accordingly. An improved are more exact control of the timing of the camshaft can be achieved thereby.

A wide variety of materials are available to the skilled person for the plastic material. Particularly preferred according to the present invention are polyamides, which have proven useful excellently in the prior art, especially polyamide 66 or PA 6, which have already been integrated in concrete vehicle projects.

The invention claimed is:

1. A cylinder head cover for a motor vehicle, made of plastic material reinforced by glass fibers and/or minerals and provided with an integrated plastic seat for actuators of a camshaft timing mechanism, wherein the seat of the actuators is stiffened by an insert component enclosed by the plastic material, which is in full-area contact with said cylinder head cover and consists of a sheet part.

2. The cylinder head cover according to claim 1, characterized in that said insert component includes a metal sheet part.

3. The cylinder head cover according to claim 1, comprising an organic, steel or aluminum sheet as the insert component.

4. The cylinder head cover according to claim 3, characterized in that said organic sheet includes glass fiber, kevlar and/or carbon fibers embedded in a thermoplastic matrix.

5. The cylinder head cover according to claim 3, characterized in that the layer thickness of the sheet is from 0.75 to 2 mm.

6. The cylinder head cover according to claim 1, characterized in that the plastic material includes polyamide.

7. The cylinder head cover according to claim 5, characterized in that the layer thickness of the sheet is from 1 to 1.5 mm.

* * * * *